US005690591A

United States Patent [19]

Kenmochi et al.

[11] Patent Number: 5,690,591

[45] Date of Patent: Nov. 25, 1997

[54] SKI TRAINING APPARATUS

[75] Inventors: Akihisa Kenmochi; Shin'ichi Fukuzumi, both of Tokyo, Japan

[73] Assignee: NEC Corporation, Tokyo, Japan

[21] Appl. No.: 527,203

[22] Filed: Sep. 12, 1995

[30] Foreign Application Priority Data

Sep. 12, 1994 [JP] Japan ..... 6-217472

[51] Int. Cl.[6] ..... A63B 22/00; A63B 71/00

[52] U.S. Cl. ..... 482/71; 434/253; 482/9

[58] Field of Search ..... 482/51, 70, 71, 482/148, 900, 901, 902, 1, 4–9; 434/253

[56] References Cited

U.S. PATENT DOCUMENTS

| | | | |
|---|---|---|---|
| 4,516,110 | 5/1985 | Overmyer | 434/253 |
| 4,906,192 | 3/1990 | Smithard et al. | 434/253 |
| 5,049,079 | 9/1991 | Furtado et al. . | |
| 5,277,678 | 1/1994 | Friedebach et al. | 434/253 |
| 5,284,460 | 2/1994 | Miller et al. | 482/71 |
| 5,391,130 | 2/1995 | Green et al. | 482/71 |

FOREIGN PATENT DOCUMENTS 0275665 7/1988 European Pat. Off. .

OTHER PUBLICATIONS

*Owner's Manual* of Pro Skifit S–830 manufactured by Tunturi, Finland, Apr. 1991.

"The effect of manipulating knowledge of results on the learning of slalom–type ski movements" by B.P.L.M. Den Brinker et al, '*Ergonomics*', 1986, vol. 29, No. 1,31–40.

Tanahashi, "Mechanism of ski–sliding—Effects of Material and Vibration Friction", *Jour. JSME,* vol. 95, No. 888, pp. 1001–1004, Nov. 1992.

*Primary Examiner*—Stephen R. Crow

*Attorney, Agent, or Firm*—Sughrue, Mion, Zinn, Macpeak & Seas

[57] ABSTRACT

A ski training apparatus includes footboards a movable portion, an apparatus body, a braking section, a movement estimating section, a braking control section, and a braking section. The movable portion supports the footboards to allow them to rotate, and displaces the footboards in accordance with ski-sliding movement. The apparatus body supports the movable portion to allow it to swing. The measuring section measures the loads of the feet of a trainee on the footboards to output load information, while measuring the displacement amount of the movable portion and the rotational angles of the footboards to output displacement information. The movement estimating section estimates a sliding velocity, the position of the trainee on a slope, and an edging strength representing the magnitude of a reactive force received from a snowy surface and corresponding to the load of the trainee on the snowy surface on the basis of the load information, the displacement information, and geographical information, and outputs movement information. The braking control section calculates a braking amount from the pieces of above information to output braking information. The braking section applies a braking force to the movable portion in accordance with the braking information.

8 Claims, 10 Drawing Sheets

SKI TRAINING APPARATUS

BACKGROUND OF THE INVENTION

The present invention relates to a ski training apparatus and, more particularly, to a ski training apparatus having a control section for measuring a loaded state and turning movement of a pair of skis, estimating a sliding state including a sliding velocity and the like on the basis of a load, the inclination of the feet, the direction of the skis, and geographical information, and performing a braking operation in accordance with the ski movement and the sliding state.

A ski training apparatus of this type can be used as sports equipment for physical training and the like, other than ski training, in gyms and hotels. Also, the apparatus can be applied to amusement equipment and virtual reality systems.

A ski training apparatus of this type is designed on the basis of the following two schemes.

In the first scheme, a user stands on footboards moving on rails, and makes repeated movement in the lateral direction along the rails. Products using this scheme include the SKIER'S EDGE available from Scientific Sports Systems, U.S.A., the WEDELN MASTER available from L•TAS•I Co., LTD, Japan, and the like.

According to this scheme, ropes attached to the footboards are coupled to springs via pulleys, the spring displacement increases as the footboards separate from the middle position of the rails in the lateral direction. The movable range of each footboard portion varies with the product. The SKIER'S EDGE allows only inward/outward inclination of the feet. The WEDELN MASTER also allows the user to change the direction of the feet.

In the second scheme, as shown in FIG. 12, a pair of horizontally supported footboards 52 on which a user puts his/her left and right feet can be rotated clockwise/counterclockwise as indicated by the arrows A, and a movable portion 5 which supports the footboards 52 can be pivoted about a main axis 51 as indicated by an arrow B. With this arrangement, the footboards 52 horizontally swing along an arcuated locus indicated by arrows C and D. The movable portion 5 is constituted by a T-shaped frame, whose base portion is pivotally supported on the main axis 51 in the form of an outer rotor. Springs 53 extend from both sides of the main axis 51 as the center and are coupled to the movable portion 5. With this arrangement, as the footboards 52 displace from the middle position of the arcuated locus, the restoring force of the springs 53 increase. Reference numeral 6 denotes a handle which the user grips with both hands in training; 7, a stationary support for supporting the handle 6; 8, a hand brake; 9, a base frame including a support portion for the movable portion 5; and 10, an apparatus body constituted by the handle 6, the stationary support 7, and the base frame. 9.

Products using this scheme include the PRO SKIFIT available from TUNTURIPYÖRÄOY, Finland and the like. The PRO SKIFIT is designed such that left and right footboards 52 are rotated clockwise/counterclockwise to express the inclination of the skis with respect to the direction of the skis as an axis. In addition, rotating movement about the main axis 51 can express outward weight shifting with respect to a turn (see OWNER'S MANUAL of Pro SkiFit S830 manufactured by TUNTURI, Finland, April, 1991).

In such a conventional ski training apparatus using either of the above schemes, since springs provide a force for restoration to the middle position, it is difficult for the user to stop at a position where the displacement of the footboards is large with respect to the middle position. For this reason, the user cannot practice turning movement with a large turning radius and traversing movement.

In addition, Since the user tends to repeat monotonous reciprocating movement, this apparatus serves for physical training rather than training for skiing techniques. Furthermore, in shifting the weight for turning movement, a force generated by sudden weight shifting is absorbed by the springs, resulting in impairment of the feeling of actually making turning movement.

As described above, the problems in the conventional ski training apparatuses are caused by a force for restoration to the middle position which is provided by the springs. In order to solve the problems, each apparatus needs to have an element for controlling the position of the footboards in accordance with a load and a displacement as well as the restoring force of the springs.

SUMMARY OF THE INVENTION

It is an object of the present invention to provide a ski training apparatus which allows turning movement with a large turning radius and traversing movement.

It is another object of the present invention to provide a ski training apparatus which allows turning movement with a large turning radius and traversing movement to prevent a user from repeating monotonous reciprocating movement, thereby providing effective training for skiing techniques.

It is still another object of the present invention to provide a ski training apparatus which generates a resistance corresponding to weight shifting for turning movement to improve the feeling of actually making turning movement.

In order to achieve the above objects, according to the present invention, there is provided a ski training apparatus comprising a pair of left and right footboards on which a trainee stands instead of skis, a movable portion which supports the footboards to allow the footboards to rotate clockwise and counterclockwise, and swings to displace the footboards along an arcuated locus in accordance with ski-sliding movement of the trainee, an apparatus body which supports the movable portion to allow the movable portion to swing in a horizontal direction, measuring means for measuring loads of the left and right feet of the trainee standing on the footboards, and outputting the measured loads as load information, while measuring a displacement amount of the movable portion and rotational angles of the footboards, and outputting the measured amount and angles as displacement information, movement estimating means for estimating a sliding velocity, a position of the trainee on a slope, and an edging strength representing a magnitude of a reactive force received from a snowy surface and corresponding to a load of the trainee on the snowy surface on the basis of the load information and the displacement information, which are supplied from the measuring means, and geographical information input in advance and indicating a state of the inclined surface on which the trainee slides, and outputting the estimated sliding velocity, position, and edging strength as movement information, and braking control means for calculating a braking amount by using the load information and the displacement information which are supplied from the measuring means and the movement information which is supplied from the movement estimating means, and outputting the braking amount as braking information, and braking means for applying a braking force to the movable portion in accordance with the braking information from the braking control means.

DESCRIPTION OF THE PREFERRED EMBODIMENTS

The present invention will be described next with reference to the accompanying drawings.

Figure 1:
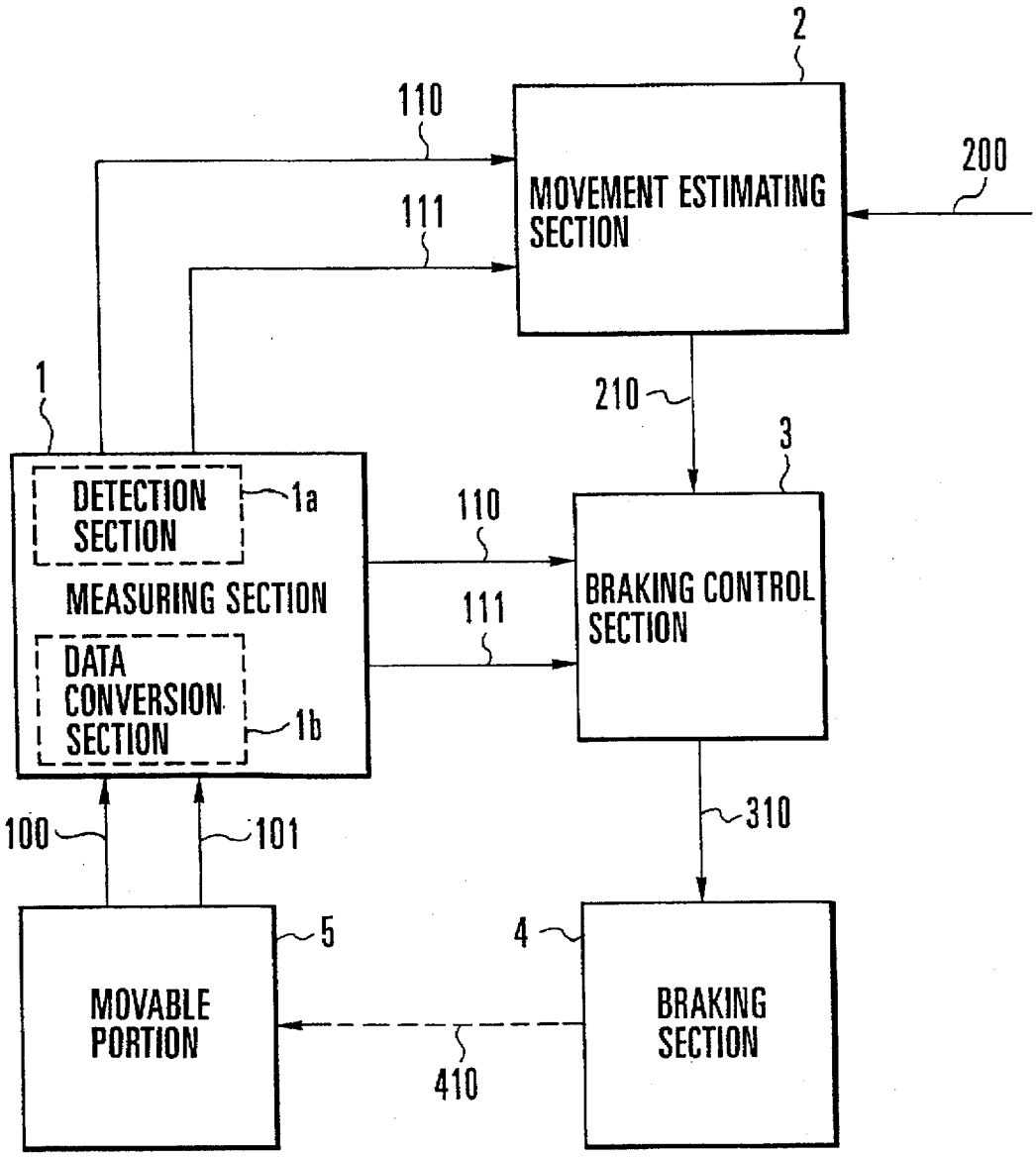
FIG. 1 is a block diagram showing a control system for a ski training apparatus according to an embodiment of the present invention.

FIG. 1 shows a control system for a ski training apparatus according to an embodiment of the present invention. Since the overall structure including the movable portion is the same as that of the ski training apparatus shown in FIG. 12, a description thereof will be omitted. Referring to FIG. 1, reference numeral 1 denotes a measuring section for measuring loads 100 on the left and right feet of a user and the displacement of a movable portion 5, and a rotational angle 101 thereof, and outputting load information 110 and displacement information 111. The measuring section 1 comprises a detection section 1*a* and a data conversion section 1*b*.

Reference numeral 2 denotes a movement estimating section for estimating a sliding velocity 201, the position of a trainee on a slope, and an edge from the load information 110 and the displacement information 111, which are supplied from the measuring section 1, and input geographical information 200, and outputting the estimated information as movement information 210; 3, a braking control section for calculating a braking amount by using the load information 110 and the displacement information 111, which are supplied from the measuring section 1, and the movement information 210 from the movement estimating section 2, and outputting the braking amount as braking information 310; and 4, a braking section for applying a braking force 410 to the movable portion 5 in accordance with the braking information 310.

Figure 2:
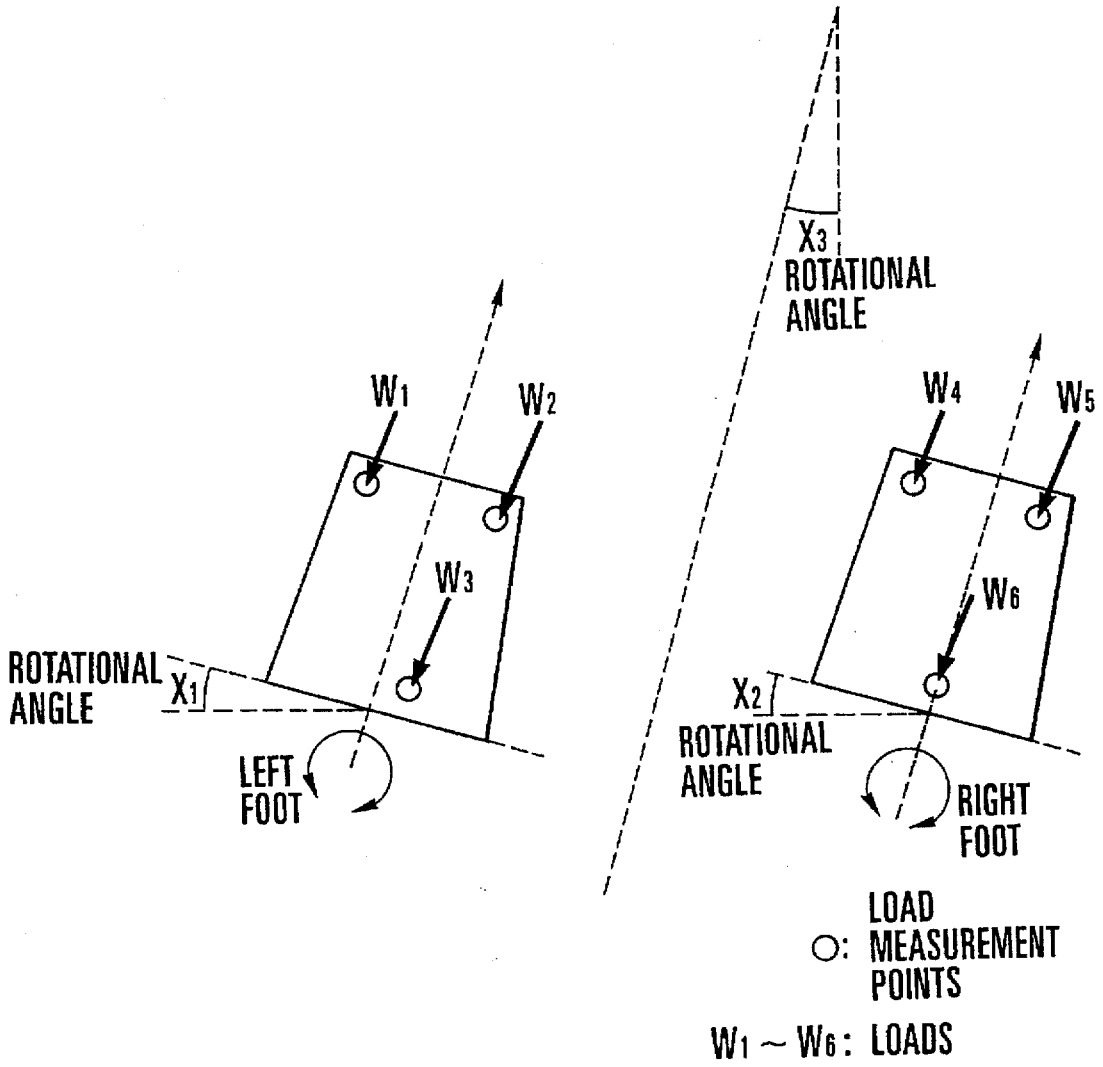
FIG. 2 is a view for explaining how load information and displacement information in FIG. 1 are measured.

The measuring section 1 detects the loads 100 of the left and right feet on the movable portion 5, the displacement amount of the movable portion 5, and rotational angles 101 of footboards 52. The detection values are respectively output as the load information 110 and the displacement information 111. The load information 110 is output in the form of $w_i$ (i=1, 2, . . . , 6); and the displacement information 111, in the form of $x_j$ (j=1, 2, 3). For example, as shown in FIG. 2, loads $w_1$ to $w_3$ and loads $w_4$ to $w_6$ at three positions on each of the left and right feet and rotational angles $x_1$ and $x_2$ of the left and right feet are detected. In addition, the overall displacement amount of the left and right feet, i.e., the movable portion 5, is detected as a rotational angle $x_3$ about a main axis 51. Let $w_1$ and $w_5$ be the loads of the little toes, $w_2$ and $w_4$ be the loads of the big toes, and $w_3$ and $w_6$ be the loads of the heels.

Figure 3:
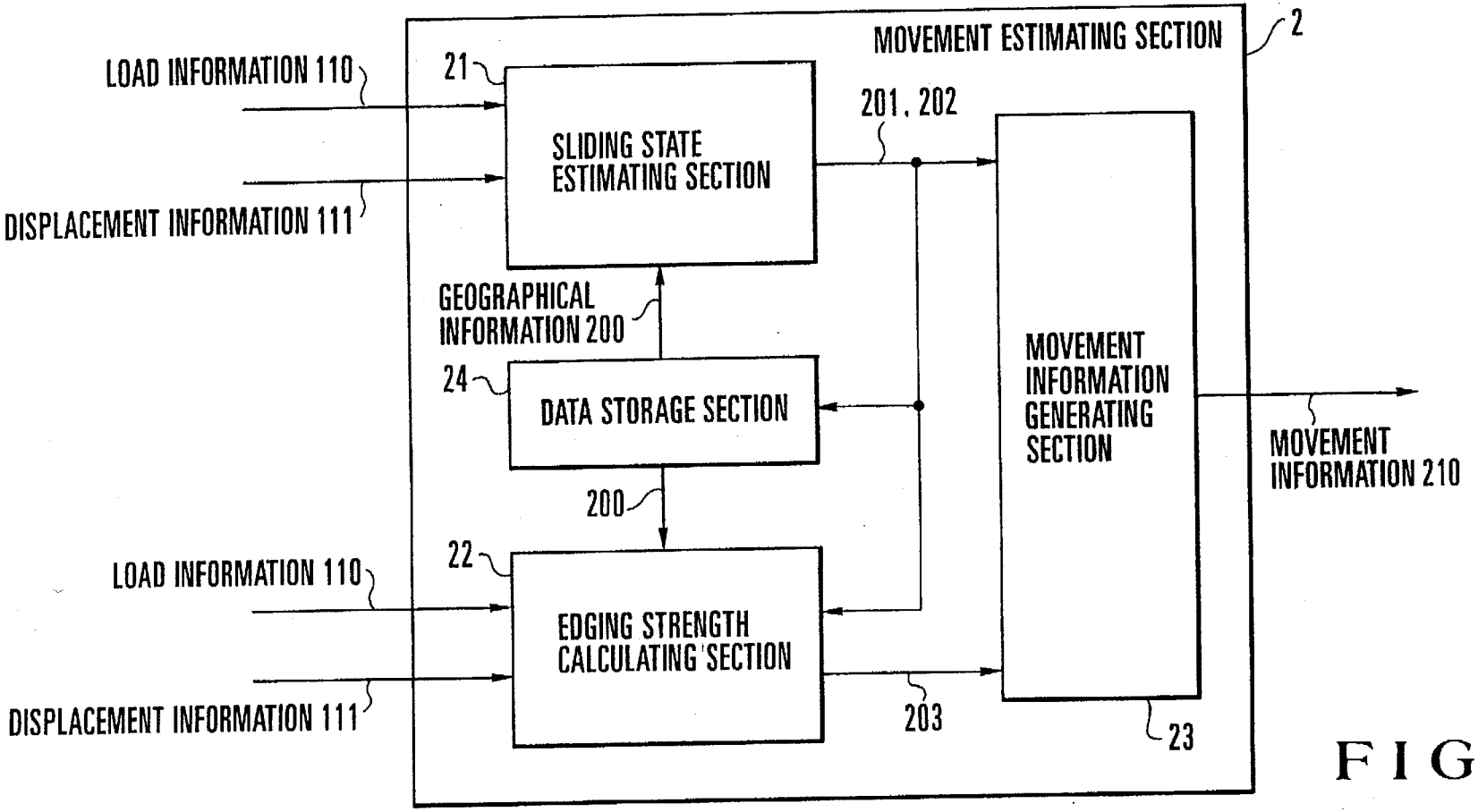
FIG. 3 is a block diagram showing a case wherein geographical information is stored in a movement estimating section in FIG. 1.
Figure 4:
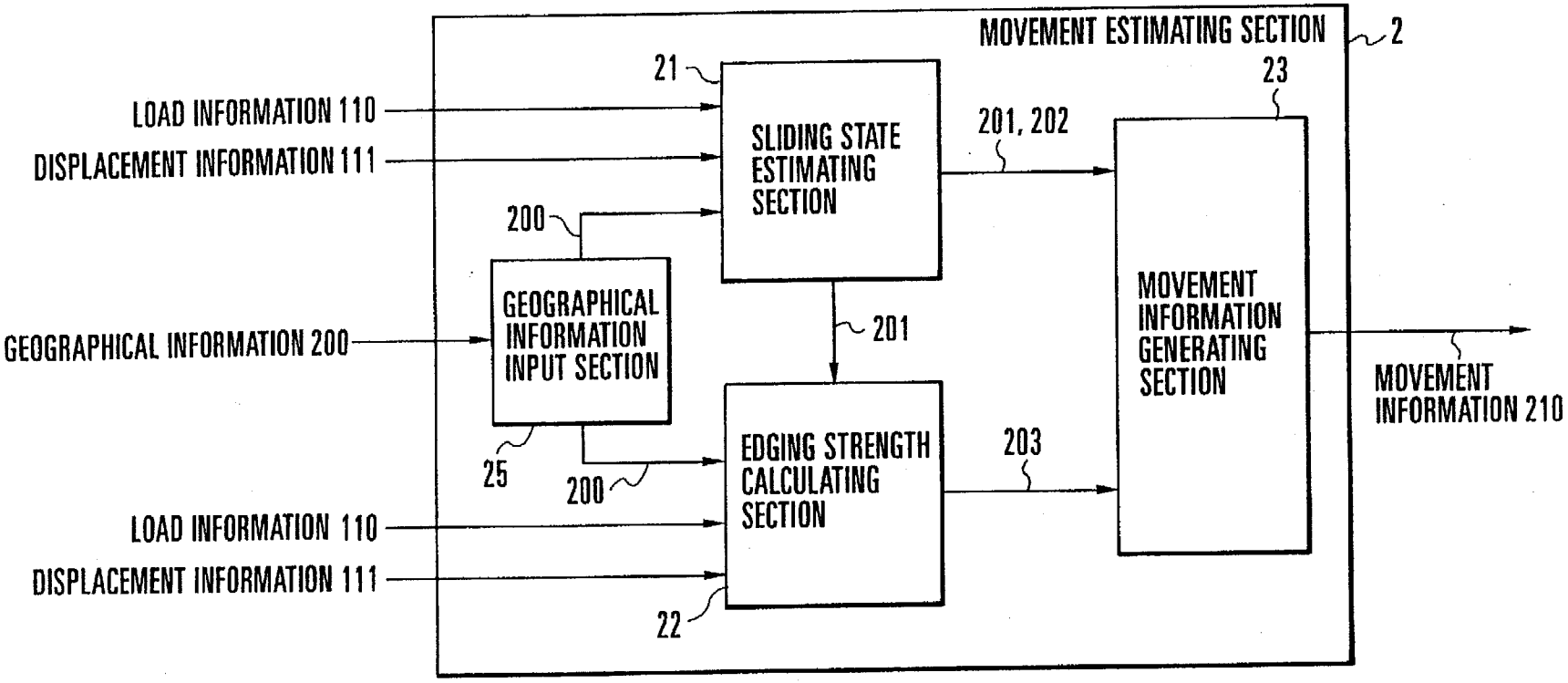
FIG. 4 is a block diagram showing a case wherein geographical information is externally input to the movement estimating section in FIG. 1.

FIGS. 3 and 4 respectively show the arrangements of the first and second examples of the movement estimating section 2. More specifically, FIG. 3 shows a case wherein the geographical information 200 is stored in the section 2, and FIG. 4 shows a case wherein the geographical information 200 is externally input.

In addition to the load information 110 and the displacement information 111, which are output from the measuring section 1, the geographical information 200 is input to the movement estimating section 2. A sliding state estimating section 21 calculates the sliding velocity 201 and a position 202 of the trainee on a slope. In addition, an edging strength calculating section 22 calculates an edging strength 203. A movement information generating section 23 generates and outputs movement information 210 as a combination of the values calculated above.

The geographical information 200 is a combination of the inclination of an inclined surface, the coefficient of kinetic friction of a snowy surface, a snow removing resistance, and the like. As shown in FIG. 3, a data storage section 24 may be arranged in the movement estimating section 2, and this information may be stored therein. Alternatively, as shown in FIG. 4, a geographical information input section 25 may be arranged in the movement estimating section 2, and such information may be externally input.

Figure 5:
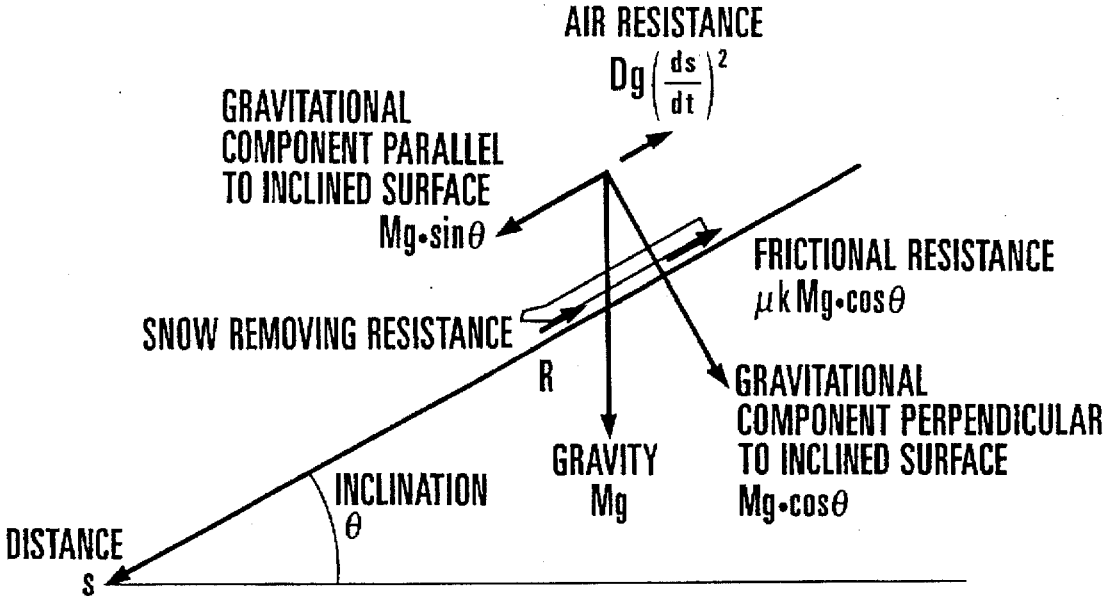
FIG. 5 is a view for explaining forces associated with the sliding movement of skis.

A method of calculating the movement information 210 in the movement estimating section 2 will be described with reference to FIG. 5. FIG. 5 explains forces associated with the sliding movement of the skis. The factors associated the sliding movement of the skis are the gravity, a frictional resistance, a snow removing resistance, and an air resistance. Sliding movement can be expressed by equation of motion (1) (TANAHASHI, "Mechanism of ski-sliding—Effects of Material and Vibration Friction" Jour. JSME, Vol. 95, 5 No. 888, pp. 1001–1004, November, 1992):

$$M\frac{d^2s}{dt^2} = Mg(\sin\theta - \mu_k\cos\theta) - R - Dg\left(\frac{ds}{dt}\right)^2 \quad (1)$$

where M is the mass (total load) of the user and the ski equipment, θ is the inclination, $\mu_k$ is the coefficient of kinetic friction between each sliding surface and the snowy surface, R is the snow removing resistance, D is the air resistance, g is the gravitational acceleration, and s is the distance.

In equation (1), from the load information 110, load amount Mg at time t is given as follows:

$$Mg=(\Sigma w_i)g \quad (2)$$

The inclination θ, the coefficient $\mu_k$, and the resistance R can be obtained as geographical information. In addition, by storing the air resistance D and the gravitational acceleration g in the movement estimating section 2, an acceleration at time t can be obtained by:

$$\frac{d^2s}{dt^2}$$

Therefore, by also storing a velocity v(0) and a distance s(0) at time t=0 in the movement estimating section 2, the velocity v at time t can be obtained by using equation (3) to rewrite equation (1) as a difference equation with respect to the velocity. In addition, the distance s at time t can be obtained by using the obtained velocity v and equation (4):

$$M\frac{v_{t+\Delta t}-v_t}{\Delta t}=Mg(\sin\theta-\mu_k\cos\theta)-R-Dg\left(\frac{v_t}{\Delta t}\right)^2 \quad (3)$$

$$s_{t+\Delta t}=s_t+v_t\Delta t \quad (4)$$

In this manner, the sliding state estimating section 21 of the movement estimating section 2 calculates the sliding velocity 201 and the position 202 of the trainee on the slope.

It can be assumed that the edging strength 203 indicating the magnitude of a reactive force from a snowy surface which corresponds to a load applied to the snowy surface increases as the difference between the direction of velocity and the direction of the skis becomes closer to a right angle, and as a reactive force produced inward from a curve, i.e., a load applied outward from the turn, increases.

A method of calculating the edging strength 203, which is based on this assumption, will be described below with reference to FIGS. 6 and 7.

Figure 6:
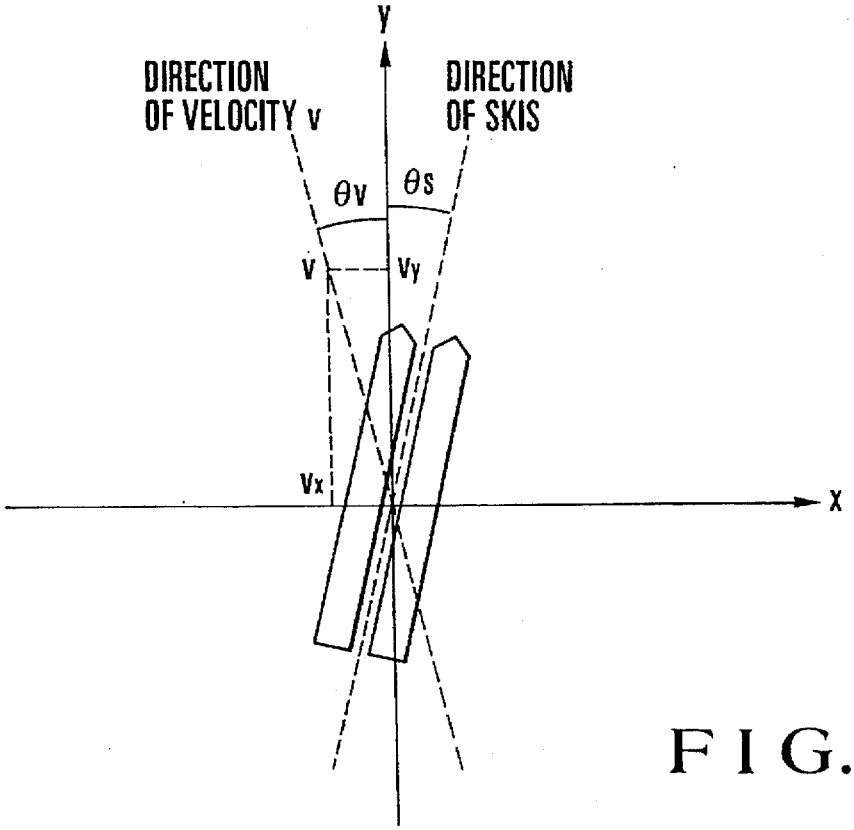
FIG. 6 is a view for explaining the relationship between the direction of velocity and the direction of each ski.

FIG. 6 shows the relationship between the direction of velocity and the direction of the skis. A coordinate system x-y on an inclined surface is set such that the inclination in the y-axis direction is maximum, i.e., the fall line coincides with the y-axis. In this case, if the sliding velocity 201, i.e., the velocity v, is expressed by $v=(v_x,v_y)$, an angle $\theta_v$ defined by the direction of the velocity v and the y-axis is given by:

$$\theta_v=\sin^{-1}\frac{v_x}{\sqrt{v_x^2+v_y^2}} \quad (5)$$

If a direction $\theta_s$ of the skis is given by the angle between the skis and the y-axis, the angle $\theta_s$ is defined, for example, by $\theta_s=x_3$ using a total rotational angle $x_3$ in FIG. 2 from the displacement information 111.

Figure 7:
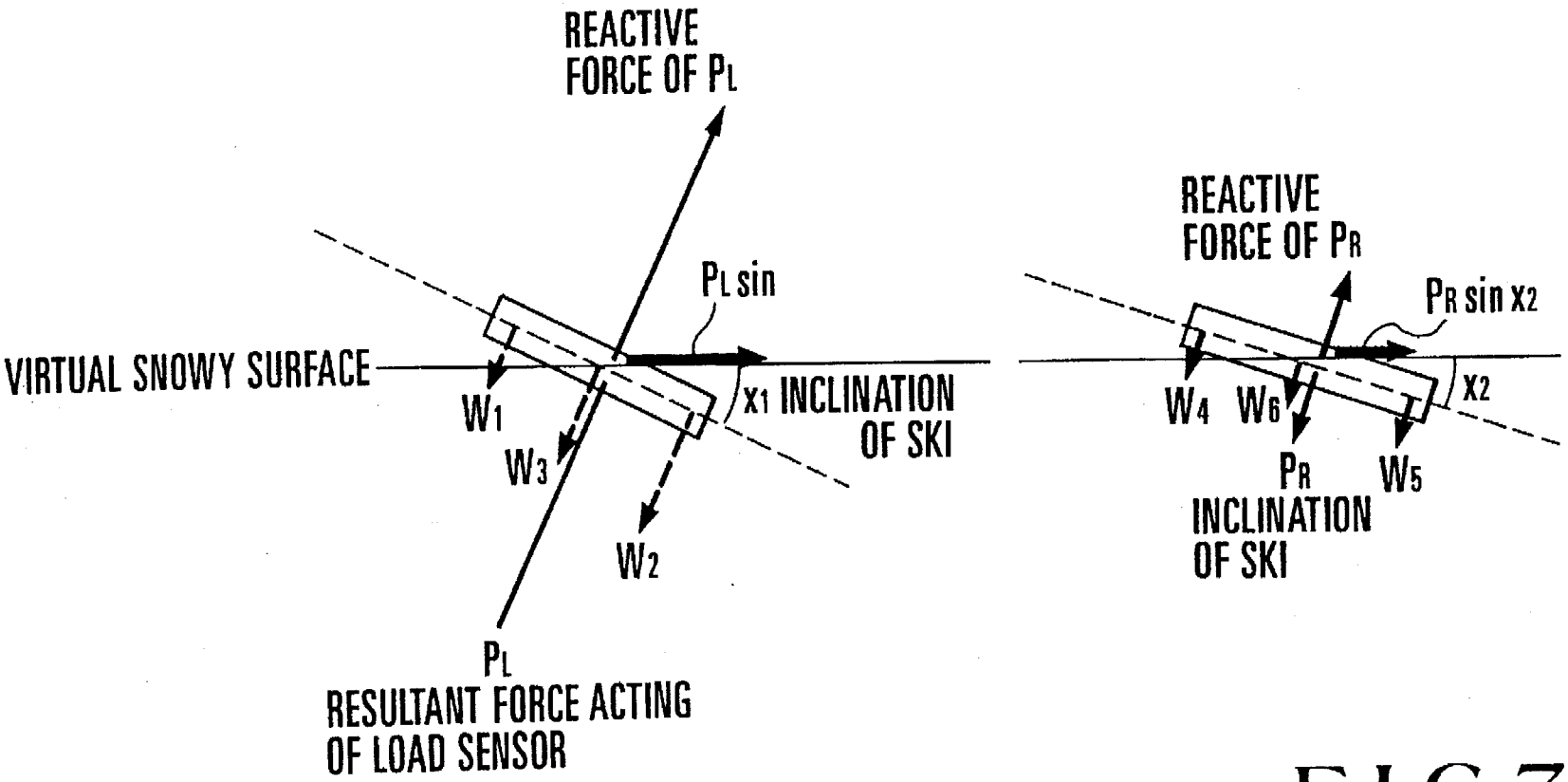
FIG. 7 is a view for explaining a reactive force produced inward from a turn.

FIG. 7 explains a reactive force produced inward from a turn. A reactive force produced inward from a turn can be obtained as a component produced by projecting the reactive force of a load onto a snowy surface in accordance with the inclination of the skis. The edging strength 203 can be calculated as a dimensionless strength independent of the weight of the user by, for example, dividing the snowy-surface-projected component of a reactive force produced inward from a turn by the total load.

According to FIG. 2, the inclination of the skis can be obtained as pieces of displacement information $x_1$ and $x_2$, and loads $P_L$ and $P_R$ of the left and right feet can be obtained by $P_L=w_1+w_2+w_3$ and $P_R=w_4+w_5+w_6$.

As shown in FIG. 7, therefore, the forces produced inward from the turn are components respectively obtained by projecting the reactive forces of the loads of the left and right feet onto the snowy surface. Letting $x_1$ and $x_2$ be the inclinations of the left and right skis, the forces are respectively represented by $P_L \sin x_1$ and $P_R \sin x_2$. The edging strength 203 therefore given by:

$$E=a\frac{w_1+w_2+w_3}{M}\sin x_1\sin(|\theta_v-\theta_s|)+b\frac{w_4+w_5+w_6}{M}\sin x_2\sin(|\theta_v-\theta_s|) \quad (6)$$

where E is the edging strength, and a and b are the weighting constants for the respective terms. Since the constants a and b can be stored in equation of motion (2), the edging strength 203 can be obtained by using equation (6). Note that a total load M can be calibrated by $M=w_1+w_2+w_3+w_4+w_5+w_6$ when the apparatus is to be used.

In this manner, the edging strength calculating section 22 of the movement estimating section 2 calculates the edging strength 203. As shown in FIG. 1, the movement estimating section 2 then outputs the movement information 210 as a combination of the sliding velocity 201, the position 202 of the trainee on the slope, and the edging strength 203 to the braking control section 3.

The braking control section 3 calculates a braking amount by using the load information 110, the displacement information 111, and the movement information 210, and outputs the calculated amount as the braking information 310. A braking amount is calculated by using, for example, the edging strength 203 and a change in sliding direction. In addition, since the moving amount changes depending on the weight of the user, the weight of the user must be used in calculating a braking amount. For example, a braking amount $C_b$ is calculated by:

$$C_b=pME \quad (7)$$

where p is a constant, M is the weight of the user, and E is the edging strength 203 described above.

In this manner, the braking amount $C_b$ is calculated by the braking control section 3 and converted into an electrical signal, e.g., a voltage signal, for controlling the braking section 4. This signal is then output as the braking information 310.

As shown in FIG. 1, therefore, the braking section 4 applies the braking force 410 to the movable portion 5 in accordance with the braking information 310 including the reactive force received from the snowy surface which is estimated in accordance with the sliding movement. This operation allows the user to stay at a position where the displacement from the middle position is large and hence allows training for turning movement with a large turning radius and traversing movement unlike a conventional apparatus which simply uses springs to provide a force for restoration to the middle position.

Figure 8A:
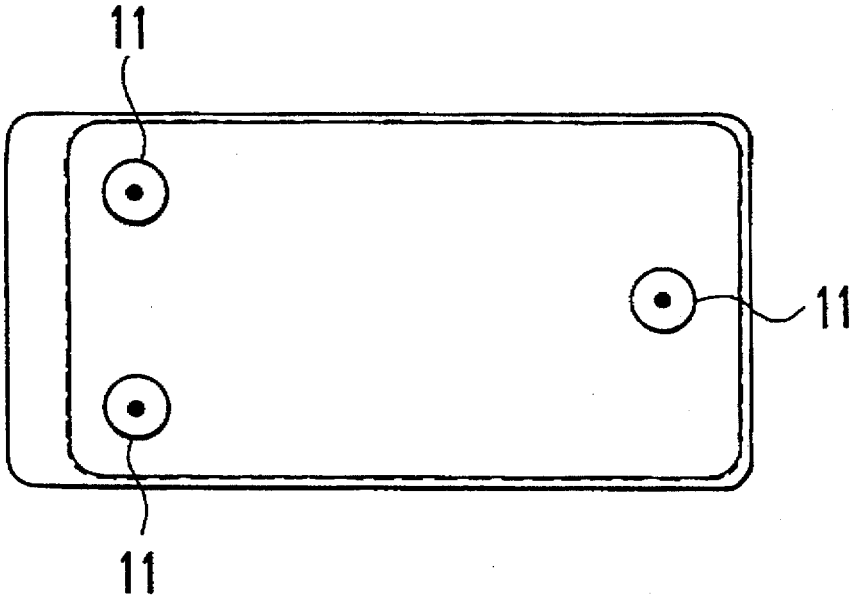
FIGS. 8A and 8B are plan and side views showing footboard portions on which load sensors are mounted.
Figure 8B:
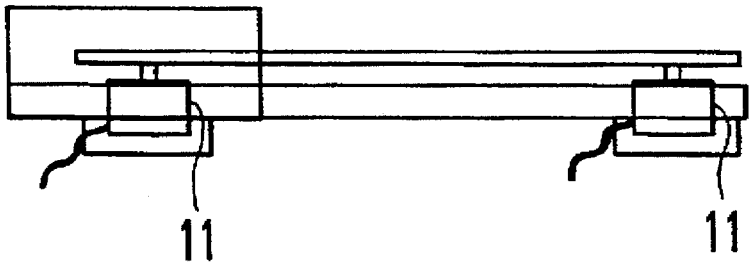

In practice, as shown in FIGS. 8A and 8B, load sensors 11 are mounted at the respective measurement points for the loads $w_1$ to $w_3$ and $w_4$ to $w_6$ in FIG. 2 on the respective portions of the footboard portions of the ski training apparatus, and outputs from the load sensors 11 are amplified by signal amplifiers, thereby detecting loads.

Figure 9A:
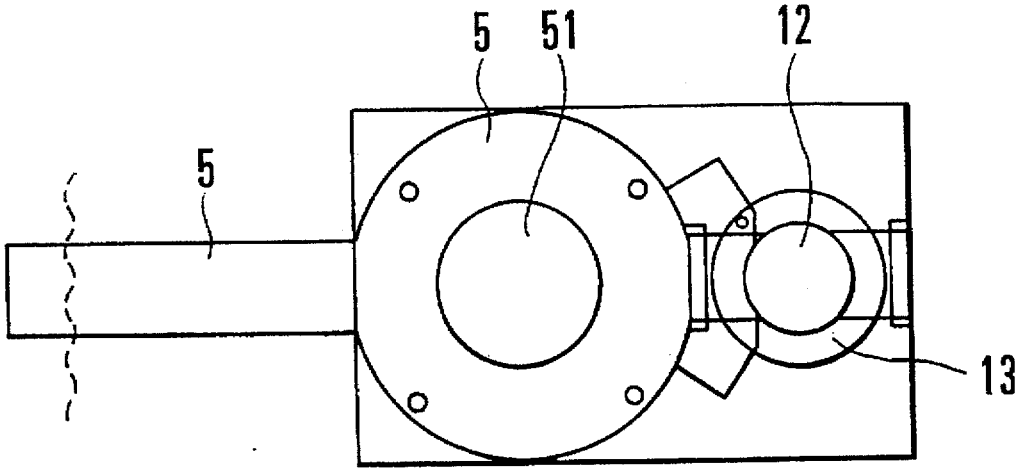
FIGS. 9A and 9B are plan and side views showing a coupling portion between a main shaft and a movable portion on which an angle sensor for the movable portion and a braking device are mounted.
Figure 9B:
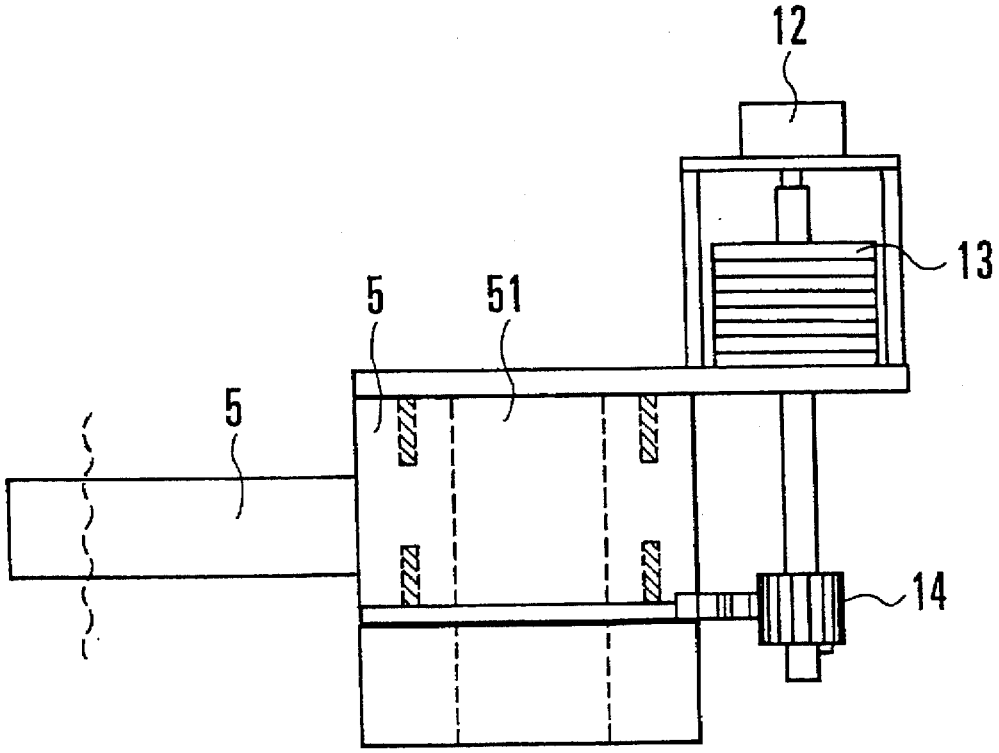
Figure 12:
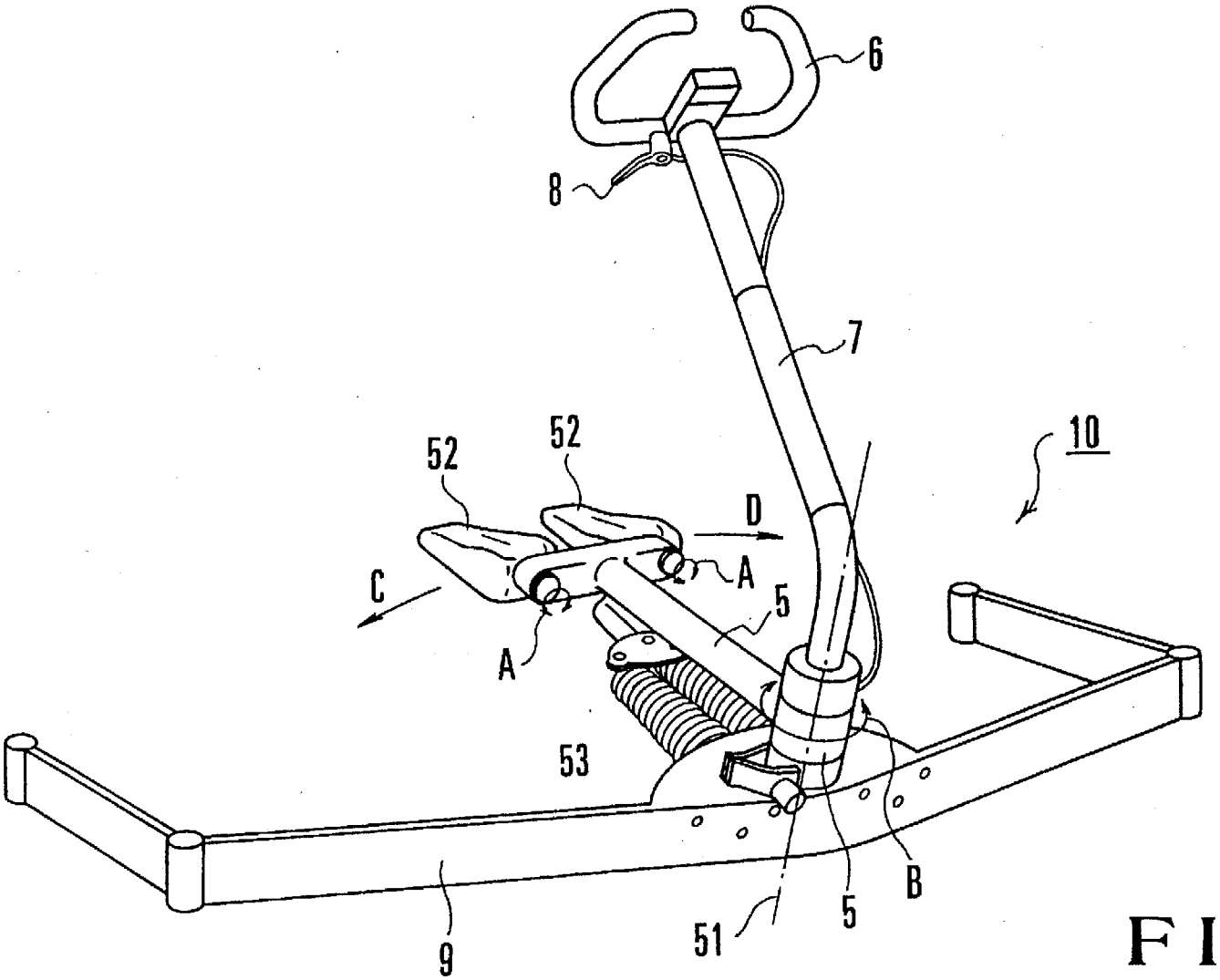
FIG. 12 is a perspective view showing the overall arrangement of a ski training apparatus.

In addition, as shown in FIGS. 9A and 9B, if a rotary encoder 12 is mounted on the coupling portion between the main shaft and the movable portion of the ski training apparatus in FIG. 12, the displacement amount, i.e., the rotational angle, of the movable portion 5 can be detected. Reference numeral 13 denotes an electromagnetic brake for applying a braking force to the movable portion 5; and 14, a gear for transmitting the displacement amount of the movable portion 5 to the rotary encoder.

Figure 10A:
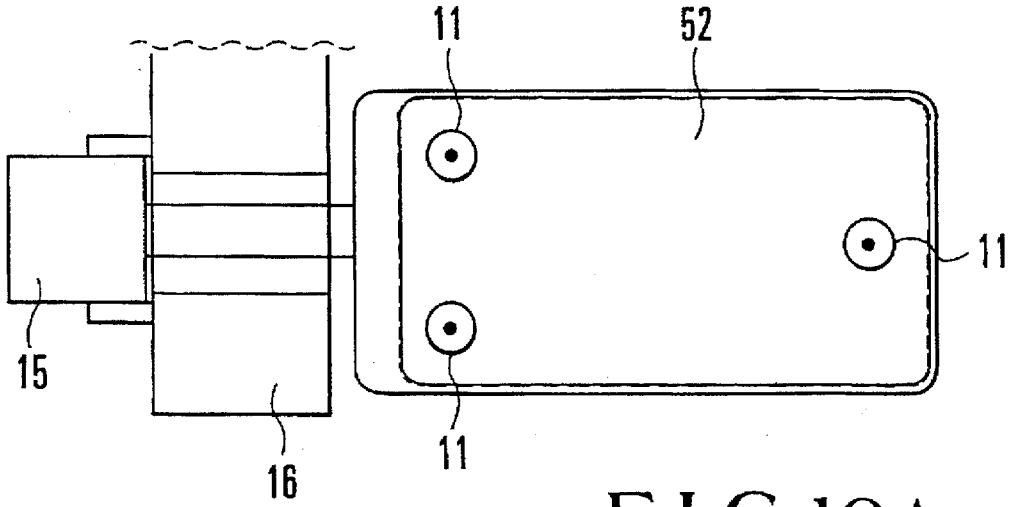
FIGS. 10A and 10B are plan and side views showing footboard portions on which angle sensors for detecting the inclinations of the left and right feet are mounted.
Figure 10B:
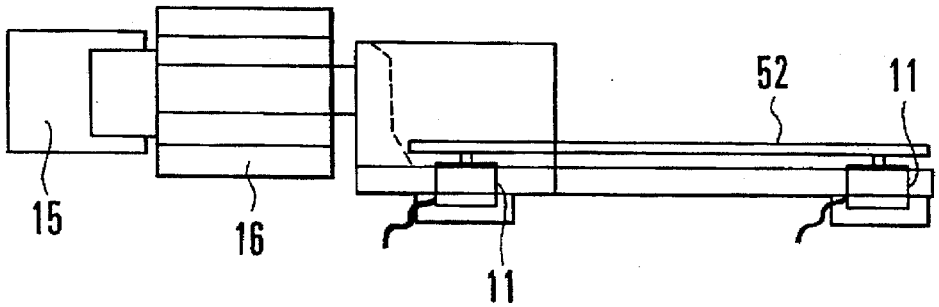

Furthermore, as shown in FIGS. 10A and 10B, if rotary encoders 15 are mounted on the support shaft portions of the footboards of the ski training apparatus in FIG. 12, the rotational angles of the footboards 52 can be detected.

With these components, the detection section 1*a* of the measuring section 1 in FIG. 1 can be realized.

The data conversion section 1*b* of the measuring section 1 can obtain an amplified output from the load converter and outputs from the rotary encoders as time-series data, and can be obtain the load information 110 and the displacement information 111*b* by using an A/D converter and a pulse counter module which are connected to a personal computer.

The measuring section 1 can be realized in the above manner.

The movement estimating section 2 in FIG. 1 can be realized by programming calculation processing of the movement information 210 described above, and executing the program on the personal computer. The data storage section 24 can be realized by using part of the main memory of the personal computer constituting the movement estimating section 2.

The geographical information input section 25 is realized by using an RS-232C communication interface of the personal computer constituting the movement estimating section 2, and executing communication processing as a program.

In the above manner, the movement estimating section 2 can be realized.

The braking control section 3 in FIG. 1 can be realized by programming calculation processing of the braking information 310 described above, executing the program on the personal computer, and outputting the braking information 310 as a digital signal by using interface circuit.

The braking section 4 can generate a voltage corresponding to a braking amount by using a variable DC voltage/constant current source and inputting the braking information 310 thereto. This voltage is applied to the braking device constituted by the dry multi-plate electromagnetic brake 13 in FIGS. 9A and 9B, thereby realizing the braking section 4.

As shown in FIG. 9, if this braking section 4 is mounted on the coupling portion between the main shaft and the movable portion of the ski training apparatus in FIG. 12, a braking force can be applied with respect to the turning movement of the skis, thereby realizing the ski training apparatus of the present invention.

Figure 11:
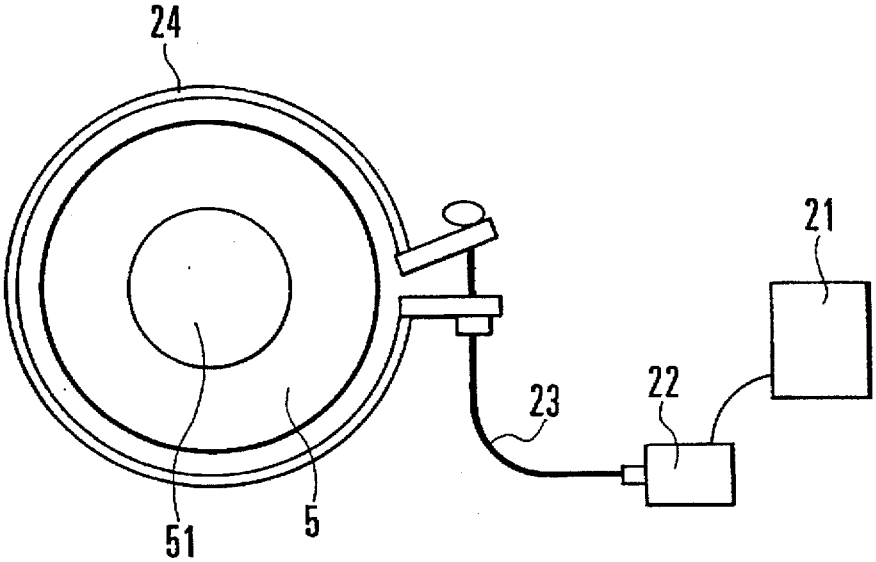
FIG. 11 is a plan view showing another coupling portion between the main shaft and the movable portion on which a braking device is mounted.

Alternatively, as shown in FIG. 11, the braking portion of a hand brake 55 attached to the ski training apparatus in FIG. 12 may be used instead of the dry multi-plate electromagnetic brake, and a variable DC voltage/constant current power supply (programmable power supply) constituting a controller 21 applies a voltage to a solenoid 22 in accordance with the braking information 310. A tensile force is applied to a wire 23 upon operation of the solenoid to fasten a braking pad 24 to brake the pivotal movement of the movable portion 5, thereby realizing the braking section 4.

As has been described above, according to the present invention, the movement estimating section estimates a sliding velocity, the position of the trainee on the slope, and an edging strength on the basis of load information and displacement information which are measured by the measuring section, and geographical information, and outputs the estimated values as movement information. The braking control section calculates a braking amount from this movement information, the load information, and the displacement information. A braking force is then applied to the movable portion in accordance with the calculated braking amount. With this operation, a reactive force received from the snowy surface is estimated, and a corresponding braking force is applied in accordance with the operation measured by the measuring section, thereby allowing training similar to actual sliding movement in addition to monotonous reciprocating movement as in a conventional apparatus.

In addition, since the geographical information includes the inclination of the inclined surface on which the user slides, the coefficient of kinetic friction of the snowy surface, and the snow removing resistance, the apparatus can provide the feeling of actually sliding on a slope with various geographical features.

Furthermore, an edging strength is obtained from a measurement value obtained as load information, a measurement value obtained as displacement information, and the total load of a trainee. Also, the edging strength increases as the angular difference between the estimated direction of the skis and the estimated direction of velocity becomes closer to a right angle. For this reason, an accurate reactive force from the snowy surface can be estimated in accordance with various types of sliding movement, thereby allowing useful ski training for skiing techniques.

What is claimed is:

1. A ski training apparatus comprising:

a pair of left and right footboards on which a trainee stands instead of skis;

a movable portion which supports said footboards to allow said footboards to rotate clockwise and counterclockwise, and swings to displace said footboards along an arcuated locus in accordance with ski-sliding movement of the trainee;

an apparatus body which supports said movable portion to allow said movable portion to swing in a horizontal direction;

measuring means for measuring loads of the left and right feet of the trainee standing on said footboards, and outputting the measured loads as load information, while measuring a displacement amount of said movable portion and rotational angles of said footboards, and outputting the measured amount and angles as displacement information;

movement estimating means for estimating a sliding velocity, a position of the trainee on a slope, and an edging strength representing a magnitude of a reactive force received from a snowy surface and corresponding to a load of the trainee on the snowy surface on the basis of the load information and the displacement information, which are supplied from said measuring means, and geographical information input in advance and indicating a state of the inclined surface on which the trainee slides, and outputting the estimated sliding velocity, position, and edging strength as movement information; and braking control means for calculating a braking amount by using the load information and the displacement information which are supplied from said measuring means and the movement information which is supplied from said movement estimating means, and outputting the braking amount as braking information; and braking means for applying a braking force to said movable portion in accordance with the braking information from said braking control means.

2. An apparatus according to claim 1, wherein the geographical information used by said movement estimating means includes an inclination of the inclined surface on which the trainee slides, a coefficient of kinetic friction of the snowy surface, and a snow removing resistance.

3. An apparatus according to claim 1, wherein said movement estimating means comprises sliding state estimating means for calculating a sliding velocity and the position of the trainee on the slope on the basis of the load information from said measuring means and geographical information indicating a state of an inclined surface on which the trainee slides, edging strength calculating means for calculating an edging strength representing a magnitude of a reactive force received from the snowy surface and corresponding to a load applied to the snowy surface on the basis of the load information and the displacement information which are supplied from said measuring means, the sliding velocity, and the geographical information indicating the state of the inclined surface on which the trainee slides, and movement information generating means for generating movement information including the sliding velocity and the position of the trainee on the slope, which are supplied from, said sliding state estimating means, and the edging strength from said edging strength calculating means.

4. An apparatus according to claim 3, wherein said sliding state estimating means obtains a velocity and a distance at an arbitrary time from a predetermined mathematic expression by using a total load of the trainee including skis as load information from said measuring means, an inclination of the inclined surface as geographical information, a kinetic friction between each sliding surface and the snowy surface, a snow removing resistance, an air resistance as a constant, and a gravitational acceleration as a constant, thereby estimating a sliding velocity and the position of the trainee on the slope.

5. An apparatus according to claim 3, wherein said edging strength calculating means calculates an edging strength from a predetermined mathematic expression by using a total load of the trainee including the skis and loads of the left and right feet, the total load and the loads of the left and right feet being based on the load information from said measuring means, a direction of each ski which is based on the displacement information from said measuring means, an inclination of each ski as the displacement information from said measuring means, a direction of velocity which is based on the sliding velocity from said sliding state estimating means, and weighting constants for the left and right skis.

6. An apparatus according to claim 5, wherein the edging strength calculated by said edging strength calculating means increases as an angular difference between the direction of each ski and a direction of velocity becomes closer to a right angle, and a force applied outward from a turn increases.

7. An apparatus according to claim 1, wherein said braking means is constituted by an electromagnetic brake for electromagnetically braking displacing movement of said movable portion.

8. An apparatus according to claim 1, further comprising a spring member for providing said movable portion with a force for restoration to a middle position.

* * * * *